US011608745B2

(12) United States Patent
Rao et al.

(10) Patent No.: US 11,608,745 B2
(45) Date of Patent: Mar. 21, 2023

(54) STRUCTURE FOR IMPROVING AERODYNAMIC EFFICIENCY OF LOW-PRESSURE TURBINE BLADE AND WORKING METHOD THEREOF

(71) Applicant: Shanghai Jiao Tong University, Shanghai (CN)

(72) Inventors: Yu Rao, Shanghai (CN); Yin Xie, Shanghai (CN); Yuli Cheng, Shanghai (CN)

(73) Assignee: Shanghai Jiao Tong University, Shanghai (CN)

( * ) Notice: Subject to any disclaimer, the term of this patent is extended or adjusted under 35 U.S.C. 154(b) by 0 days.

(21) Appl. No.: 17/948,366

(22) Filed: Sep. 20, 2022

(65) Prior Publication Data

US 2023/0010937 A1 Jan. 12, 2023

(51) Int. Cl.
*F01D 5/14* (2006.01)

(52) U.S. Cl.
CPC ..... *F01D 5/145* (2013.01); *F01D 5/147* (2013.01)

(58) Field of Classification Search
CPC ..... F01D 5/145; F01D 5/147
See application file for complete search history.

(56) References Cited

U.S. PATENT DOCUMENTS

| | | | | |
|---|---|---|---|---|
| 9,080,451 | B2 * | 7/2015 | Simpson | F01D 5/186 |
| 2014/0003960 | A1 | 1/2014 | Simpson | |
| 2017/0030201 | A1 * | 2/2017 | Rao | F23R 3/002 |

FOREIGN PATENT DOCUMENTS

| | | | | |
|---|---|---|---|---|
| CN | 104314618 | A | 1/2015 | |
| CN | 109441554 | A | 3/2019 | |
| CN | 112177680 | A * | 1/2021 | F01D 5/145 |
| CN | 112177680 | A | 1/2021 | |
| EP | 2369133 | A1 | 9/2011 | |

* cited by examiner

*Primary Examiner* — Sabbir Hasan

(57) ABSTRACT

A turbine blade structure for improving aerodynamic efficiency of low-pressure turbine blades, including: a suction side, a pressure side, multiple dimples and a blade body. The suction side is an outer convex side of the blade body. The pressure side is an inner concave side of the blade body. The dimples are arranged on the suction side in pairs. Each dimple forms an inclination angle β with an air flow. The air flow includes a first fluid and a second fluid, and the energy of the first fluid is lower than that of the second fluid. Each dimple sucks the first fluid at a first end when the air flow passes a surface of the blade body, and allows the first fluid to spirally flow along an inclined direction in each dimple to form a spiral vortex, and discharge the first fluid through a second end.

2 Claims, 1 Drawing Sheet

STRUCTURE FOR IMPROVING AERODYNAMIC EFFICIENCY OF LOW-PRESSURE TURBINE BLADE AND WORKING METHOD THEREOF

CROSS-REFERENCE TO RELATED APPLICATIONS

This application claims the benefit of priority from Chinese Patent Application No. 202111203932.2, filed on Oct. 15, 2021. The content of the aforementioned application, including any intervening amendments thereto, is incorporated herein by reference in its entirety.

TECHNICAL FIELD

This application relates to turbine blades for aero-engines, and more particularly to a structure for improving aerodynamic efficiency of a low-pressure turbine blade, and a working method thereof.

BACKGROUND

As an indispensable component in aero-engines, the gas turbine plays a role in converting thermal energy from high-temperature and high-pressure (HTHP) gas (working fluid) into mechanical work during operation of the aero-engines.

After flowing through passages between the turbine blades, the HTHP gas experiences a temperature and pressure decline, and during this process, the internal energy of the HTHP gas is converted into kinetic energy and then into mechanical energy. There is an interaction between the gas flow and the turbine blades, and thus the gas turbine can output mechanical work. Regarding a turbofan aero-engine, the output work of a low-pressure turbine is used to drive a fan of the turbofan aero-engine, and then the fan drives the air flow to pass through the engine to generate the main engine thrust. Therefore, the working efficiency and aerodynamic performance of the low-pressure turbine are associated with the overall engine performance.

Turbine cascade refers to a blade assembly formed by a group of stationary blades or moving blades in the turbine. Concave profile and convex of adjacent stationary blades or moving blades and upper and lower end walls together constitute a gas flow passage. When the gas passes through the stationary cascade, the thermal energy is converted into kinetic energy. When the gas passes through the moving cascade, thermal energy is partially converted into kinetic energy, which is further converted into mechanical work. During the operation, the HTHP gas is expanded and accelerated after flowing through the stationary cascade flow passage, and then flows out in a certain direction. After that, the gas continues to expand in the moving cascade passage to convert the kinetic energy into mechanical work.

Chinese Patent Application Publication No. 104314618 A discloses a low-pressure turbine blade structure and a method for reducing the blade loss. The proposed structure includes a leading edge, a suction side, a pressure side and a trailing edge, where the suction side is provided with a roughness strip whose initial and ending positions are determined according to a two-dimensional profile of a high-middle part of the low-pressure turbine blade. By increasing the roughness (varying along the flow direction) of the blade surface upstream of a separation point at the suction side, the low-energy flow transition on the blade surface is accelerated, improving the efficiency and working margin of the low-pressure turbine. Whereas, this method will bring additional flow loss on the suction side at high Reynolds number, and fails to improve the aerodynamic performance.

Another Chinese Patent Application Publication No. 112177680 A discloses a high-pressure turbine blade structure with anti-drag dimple array, where anti-drag dimples are arranged at a middle chord of a suction side and a trailing edge of the high-pressure turbine blade for flow separation control on the suction side to reduce the flow loss. Notwithstanding, this structure only works when the main flow separation occurs at the dimple array. For the actual operation under variable conditions, the main flow separation may be advanced or delayed, and thus the flow control and drag reduction effect of the expanded dimples will be limited, and even a drag increasing effect will be produced for the main flow with high Reynolds number. It is mainly because that a strong reverse flow vortex will be produced inside the dimples, and an area of the reverse flow vortex will be further increased by the dimples. The reverse flow vortex scours a leading edge of the dimples, and mixes with the main flow, which will significantly aggravate the aerodynamic loss of the main flow. In addition, the reverse flow vortex additionally consumes the flow energy, weakening the aerodynamic drag reduction effect of the blade. Under high Reynolds number conditions, large-area flow separation does not occur where the dimples are arranged on the blade surface, but flow separation and reverse flow vortices are generated inside the dimples, generating additional significant flow losses. Therefore, the high-pressure turbine blade is applicable merely in a narrow Reynolds number range.

Currently, the turbine blades of the aero-engines are designed to have higher loads, such that the blade curvature is getting larger and larger. In this case, the flow separation is prone to occurring at the suction side, especially under a low Reynolds number flow condition. Within the Reynolds number range of 5000-50000, the fluid in the boundary layer has low kinetic energy, and the curved high-load turbine blade is more likely to cause flow separation, causing larger turbine aerodynamic loss, weakening the through-flow performance and energy conversion efficiency, and increasing the engine fuel consumption. The low Reynolds number conditions usually occur in small turbofan aero-engines and during the high-altitude operation of turbofan aero-engines.

Therefore, it is urgently needed to develop a turbine blade structure to eliminate or reduce the flow separation on the suction side when operating under a low Reynolds number condition, improving an aerodynamic performance of the high-load low-pressure turbine, and avoiding additional aerodynamic loss under a high Reynolds number condition.

SUMMARY

An object of the present disclosure is to provide a turbine blade structure with improved aerodynamic efficiency and a working method thereof to overcome the adverse pressure gradient at the rear portion of the suction side, suppress or delay the flow separation on the suction side, improve the aerodynamic performance under a low Reynolds number condition and expand the applicable operating range.

Technical solutions of this application are described as follows.

In a first aspect, this application provides a turbine blade structure, comprising:

a suction side;

a pressure side;

a plurality of dimples; and a blade body;

wherein the suction side is an outer convex side of the blade body; and the pressure side is an inner concave side of the blade body;

the plurality of dimples are arranged on the suction side in pairs in a V-shaped manner; and each of the plurality of dimples forms an inclination angle β with an air flow;

the air flow comprises a first fluid and a second fluid, and the energy of the first fluid is lower than that of the second fluid; each of the plurality of dimples is configured to suck the first fluid at a first end when the air flow passes a surface of the blade body, and allow the first fluid to spirally flow along an inclined direction in each of the plurality of dimples to form a spiral vortex, and discharge the first fluid through a second end.

In some embodiments, the plurality of dimples are arranged at an area on the suction side where flow separation occurs, wherein the area is located at 50-90% of a chord length of the blade body from a leading edge.

In some embodiments, the plurality of dimples are arranged after 50% of the chord length of the blade body.

In some embodiments, each of the plurality of dimples comprises an upstream section and a downstream section; the upstream section is a hemispherical surface with a diameter of $D_2$; the downstream section is a hemispherical surface with a diameter of $D_1$; and $D_1$ is greater than or equal to $D_2$.

In some embodiments, each of the plurality of dimples further comprises a middle section; the middle section is a cylindrical or conical surface to achieve smooth transition between the upstream section and the downstream section; and from an end of the middle section connected with the upstream section to an end of the middle section connected with the downstream section, a diameter of the middle section increases.

In some embodiments, the inclination angle β is 0-90° .

In some embodiments, a narrowness of each of the plurality of dimples is calculated by $L/D_1$, wherein L is a distance between a center of the upstream section and a center of the downstream section; and a value of the $L/D_1$ is 1-10.

In some embodiments, a first depth ratio of each of the plurality of dimples is calculated by $h_1/D_1$, wherein $h_1$ is a depth of the upstream section; a second depth ratio of each of the plurality of dimples is calculated by $h_2/D_2$, wherein $h_2$ is a depth of the downstream section; and the first depth ratio and the second depth ratio are both 0-0.2, In some embodiments, the downstream section and the upstream section of each of the plurality of dimples are respectively provided with an edge fillet.

In a second aspect, this application provides a working method of the above-mentioned turbine blade structure, comprising:

generating a spiral vortex through the turbine blade structure; and subjecting an air flow to attachment at the downstream section of each of the plurality of dimples to delay flow separation on the suction side.

Compared to the prior art, the disclosure has the following technical effects.

(1) Due to the spiral vortex forming inside the inclined dimples on the surface of the blade body, high-intensity and wide-range flow attachment is generated at the downstream section of the dimples, delaying the flow separation to a rear surface of the blade body for better turbine blade drag reduction.

(2) The dimples are arranged in a V-shaped manner, such that a covered chord length of the blade body is longer. Under high Reynolds number condition, the flow separation on the blade surface is delayed, providing better flow control and drag reduction.

(3) By means of the turbine blade structure provided herein, the aerodynamic performance of turbine blades under low Reynolds number conditions is improved. In addition, a flow drag of the turbine blade will not increase under high Reynolds number conditions, developing a high efficiency and stable working range of turbines.

BRIEF DESCRIPTION OF THE DRAWINGS

The present disclosure will be described in detail below with reference to the embodiments and accompanying drawings to make objects, features and advantages of the present disclosure clearer.

DETAILED DESCRIPTION OF EMBODIMENTS

The present disclosure will be described below in detail with reference to the embodiments. It is apparent that the embodiments are merely illustrative and are not intended to limit the disclosure. It should be noted that any variations and improvements made by those of ordinary skilled in the art without departing from the spirit of the disclosure shall fall within the scope of the disclosure defined by the appended claims.

Figure 1:
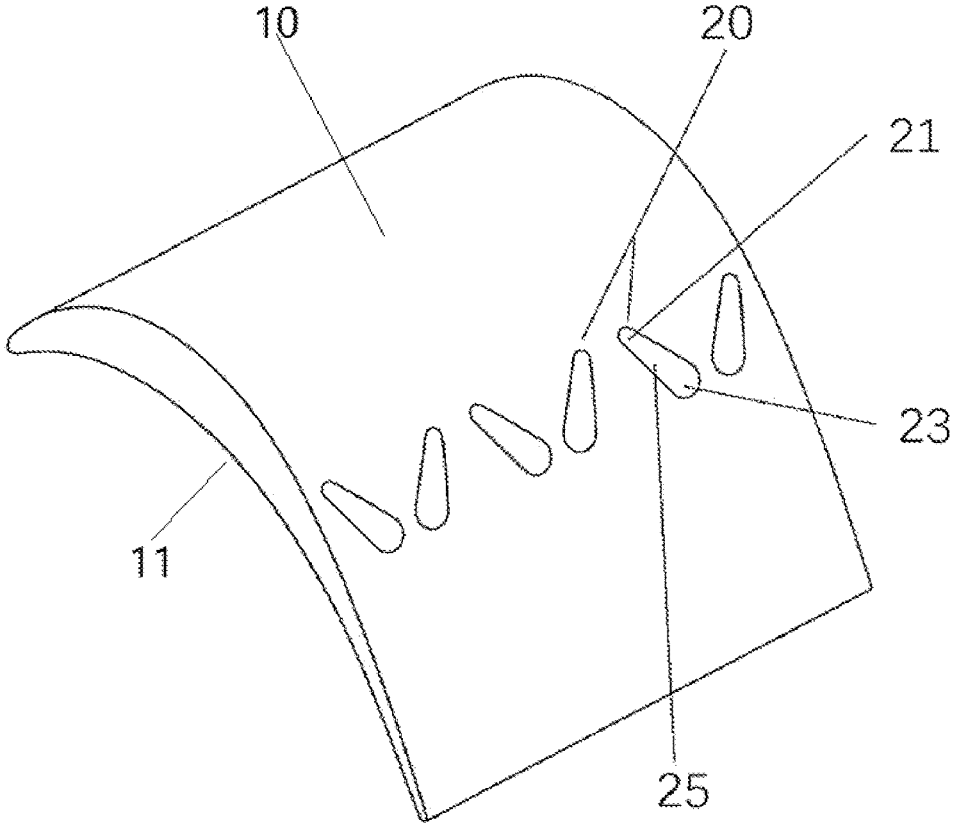
FIG. 1 schematically depicts an overall structure of a turbine blade structure according to an embodiment of the present disclosure.
Figure 2:
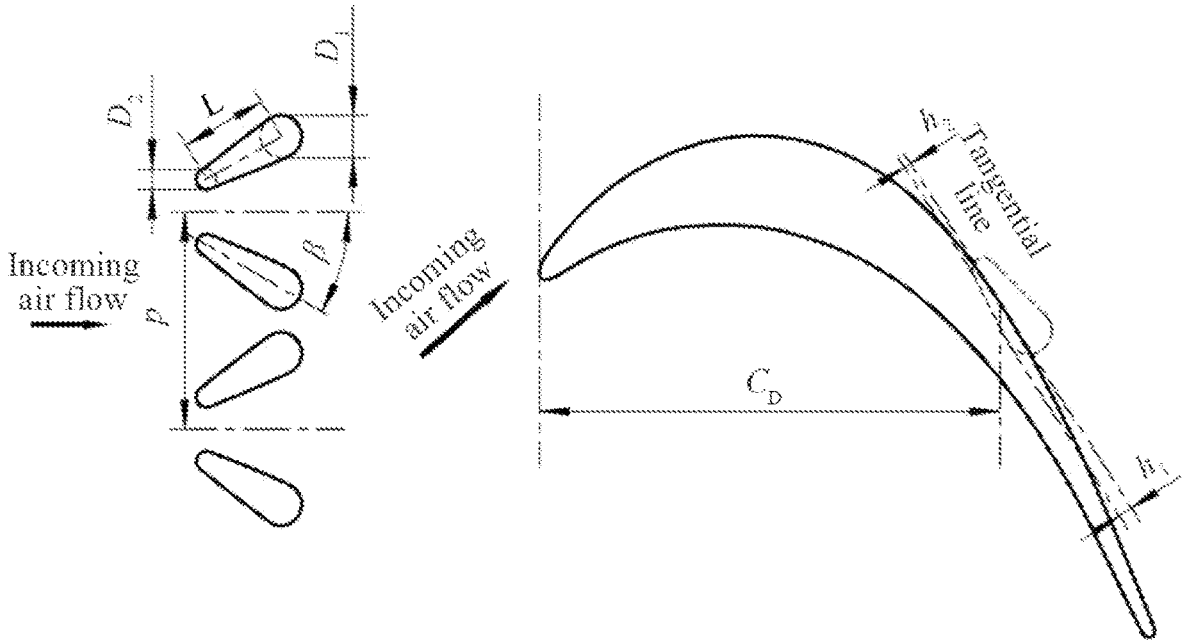
FIG. 2 is a sectional view of the turbine blade structure according to an embodiment of the present disclosure.

As shown in FIGS. 1-2, a turbine blade structure includes a suction side 10, a pressure side 11, multiple dimples 20 and a blade body. The suction side 10 is an outer convex side of the blade body. The pressure side 11 is an inner concave side of the blade body. The dimples 20 are arranged on the suction side 10 in pairs. Each of the dimples 20 forms an inclination angle β with an air flow. The air flow includes a first fluid and a second fluid, and an energy of the first fluid is lower than that of the second fluid. Each of the dimples 20 is configured to suck the first fluid when the air flow passes through a surface of the blade body, and allow the first fluid to spirally flow along an inclined direction in each of the dimples 20 to form a spiral vortex, and discharge the first fluid through a second end. When the air flow passes through the dimples 20 on the suction side 10, due to a reduction of shear stress of the suction side 10, the fluid above the suction side 10 is accelerated and attached to a suction surface downstream the dimples 20, increasing the flow energy of the downstream boundary layer. In addition, a spiral direction of the spiral vortex inside each of dimples 20 is consistent with a direction of a main flow above the suction side. The spiral vortex brings the main flow near to the suction side, thus increasing a flow kinetic energy near the suction side and promoting a flow transition near the suction side.

The dimples 20 are arranged at an area on the suction side where flow separation occurs, where the area is located at 50-90% of a chord length of the blade body from a leading edge. Each dimple 20 includes an upstream section 21, a downstream section 23 and a middle section 25. The upstream section 21 is a hemispherical surface with a diameter of $D_2$. The downstream section 23 is a hemispherical surface with a diameter of $D_1$. $D_1$ is greater than or equal to $D_2$. The middle section 25 is a cylindrical or conical surface to achieve smooth transition between the upstream section and the downstream section. From an end of the middle section 25 connected with the upstream section 21 to an end of the middle section connected with the downstream section 23, a diameter of the middle section 25 increases. The inclination angle β is 0-90° .

A narrowness of each of the dimples 20 is calculated by $L/D_1$, where L is a distance between a center of the upstream section 21 and a center of the downstream section 23. A value of the $L/D_1$ is 1-10.

A first depth ratio of the dimples 20 is calculated by $h_1/D_1$, where $h_1$ is a depth of the upstream section 21. A second depth ratio of the dimples 20 is calculated by $h_2/D_2$, where $h_2$ is a depth of the downstream section 23. The first depth ratio and the second depth ratio are both 0-0.2.

In an embodiment, the dimples 20 are arranged after 50% of the chord length of the blade body;

In an embodiment, the inclination angle β is 30-60° .

In an embodiment, the value of the $L/D_1$ is greater than 3 for a better concave effect.

In an embodiment, the first depth ratio and the second depth ratio are both 0.05-0.2 for a better effect. A depth ratio of each of the dimples 20 is varied. A depth of each of the dimples becomes shallower from the downstream section to the upstream section. The downstream section is bigger and deeper, and the first depth ratio is 0-0.2. The upstream section is shallower, and the second depth ratio is 0-0.2.

The turbine blade structure provided herein can eliminate or reduce the flow separation at the suction side when operating under a low Reynolds number condition, improving an aerodynamic performance of the high-load low-pressure turbine, avoiding additional aerodynamic loss under a high Reynolds number condition, and rendering a wilder turbine blade operating range. The air flow on the surface of the blade body interacts with the inclined dimples, such that the first fluid near the suction side allows to spirally flow inside the downstream section 23 of each of the dimples 20, and then is discharged through an end of the upstream section 21. Regarding the turbine blade structure provided herein, the spiral vortex can be discharged constantly, and the second fluid is subjected to attachment at a rear suction side, which provides significant flow control superiority over other blades in which vortices reside in the dimples.

In an embodiment, the diameter of the downstream section 23 is twice the diameter of the upstream section 21.

In an embodiment, the downstream section 23 and the upstream section 21 are respectively provided with an edge fillet to reduce flow loss of the air flow after attachment at a trailing edge of each of the dimples, and to discharge the spiral vortex from the dimples.

In an embodiment, the dimples 20 are arranged in a V-shaped manner with a top end towards an air flow upstream or downstream.

Provided herein is a working method of the above-mentioned turbine blade structure. The spiral vortex is generated through the turbine blade structure. The air flow is subjected to attachment at the downstream section 23 of each of the dimples 20 to delay flow separation on the suction side 10 for drag reduction.

Due to the variation of Reynolds number and air flow parameters, the flow separation occurs at different areas. When the Reynolds number is low, the flow separation occurs near an upstream surface of the blade body. When the Reynolds number is high, the flow separation occurs near a downstream surface of the blade body. By means of the inclined dimples, variation of area for flow separation can be adapted, realizing a wider effective working range for suppressing the flow separation.

The inclined dimples on the suction side reduce the influence of the downstream flow separation or adverse pressure gradient over the turbine blade on the upstream flow, causing less flow separation at the upstream section of each of the dimples, and facilitating drag reduction.

The spiral vortex can be generated inside the dimples 20, which reduces shear force of an external main flow and guides external high-energy fluid to the surface of the blade, improving kinetic energy of the fluid near the surface. A spiral direction of the vortex is consistent with a direction of the external main flow to reduce shear stress, so as to accelerate the external main flow near the surface.

By means of the bigger and deeper downstream section 23 of each of the dimples 20, more downstream low-energy fluids near the suction side are guided into the dimples 20, leading to a stronger interaction between the high-speed main flow and the dimples above the suction side, and making a stronger spiral vortex inside the dimples 20.

By means of the narrower and shallower upstream section 21 of each of the dimples 20, the flow separation reduces, the spiral vortex can flow out from the upstream section 21 and be carried by upstream high-energy fluid. Under a high Reynolds number condition, the upstream section 21 of each of the dimples 20 avoids to introduce additional flow losses when the flow separation does not occur in the upstream section 21 of each of the dimples 20, making a wilder aerodynamic drag reduction range of turbine.

As used herein, terms "up", "down", "front", "back", "left", "right", "vertical", "horizontal", "top", "bottom", "inner" and "outer" refer to orientational or positional relationship shown in the drawings, which are merely for better description of the present disclosure instead of indicating or implying that the device or element referred to must have a specific orientation, be constructed and operated in a specific orientation. Therefore, these terms should not be construed as a limitation to the present disclosure.

Described above are only some embodiments of the present disclosure, which are not intended to limit the disclosure. Any variations and modifications made by those of ordinary skilled in the art without departing from the spirit of the disclosure should fall within the scope of the disclosure defined by the appended claims.

What is claimed is:

1. A turbine blade structure, comprising:

a suction side;

a pressure side;

a plurality of dimples; and a blade body;

wherein the suction side is an outer convex side of the blade body; and the pressure side is an inner concave side of the blade body;

the plurality of dimples are arranged on the suction side in pairs in a V-shaped manner; and each of the plurality of dimples forms an inclination angle β with an air flow;

the air flow comprises a first fluid and a second fluid, and an energy of the first fluid is lower than that of the second fluid; each of the plurality of dimples is configured to suck the first fluid at a first end when the air flow passes a surface of the blade body, and allow the first fluid to spirally flow along an inclined direction in each of the plurality of dimples to form a spiral vortex, and discharge the first fluid through a second end;

a spiral direction of the spiral vortex inside each of the plurality of dimples is consistent with a direction of a main flow above the suction side;

the plurality of dimples are arranged at an area on the suction side where flow separation occurs, wherein the area is located at 50-90% of a chord length of the blade body from a leading edge;

each of the plurality of dimples comprises an upstream section, a downstream section and a middle section; the upstream section is a hemispherical surface with a diameter of $D_2$; the downstream section is a hemispherical surface with a diameter of $D_1$; and $D_1$ is greater than or equal to $D_2$;

the middle section is a cylindrical or conical surface to achieve smooth transition between the upstream section and the downstream section; and from an end of the middle section connected with the upstream section to an end of the middle section connected with the downstream section, a diameter of the middle section remains the same or increases;

the inclination angle $\beta$ is 0-90°;

a narrowness of each of the plurality of dimples is calculated by $L/D_1$, wherein L is a distance between a center of the upstream section and a center of the downstream section; and a value of the $L/D_1$ is 1-10;

a first depth ratio of each of the plurality of dimples is calculated by $h_1/D_1$, wherein $h_1$ is a depth of the upstream section; a second depth ratio of each of the plurality of dimples is calculated by $h_2/D_2$, wherein $h_2$ is a depth of the downstream section; and the first depth ratio and the second depth ratio are both 0-0.2; and the downstream section and the upstream section of each of the plurality of dimples are respectively provided with an edge fillet.

2. A working method of the turbine blade structure of claim 1, comprising:

generating a spiral vortex through the turbine blade structure; and subjecting an air flow to attachment at the downstream section of each of the plurality of dimples to delay flow separation on the suction side.

* * * * *